US006095766A

United States Patent [19]

Brown

[11] Patent Number: 6,095,766

[45] Date of Patent: Aug. 1, 2000

[54] FUEL TRANSFER PUMP

[76] Inventor: Albert W. Brown, 1207 Pembroke La., Newport Beach, Calif. 92660

[21] Appl. No.: 09/124,315

[22] Filed: Jul. 29, 1998

[51] Int. Cl.[7] ..... F04B 17/00; F04D 29/08; F04D 29/04

[52] U.S. Cl. ..... 417/398; 415/111

[58] Field of Search ..... 417/366, 370, 417/373, 368, 367, 375, 365, 398, 405; 415/110, 111, 175

[56] References Cited

U.S. PATENT DOCUMENTS

| | | | |
|---|---|---|---|
| Re. 35,404 | 12/1996 | Brown | 415/110 |
| 1,704,362 | 3/1929 | Johnson | 310/157 |
| 2,349,131 | 5/1944 | Anderson | 384/415 |
| 2,390,332 | 12/1945 | Schmidt | 415/175 |
| 2,826,148 | 3/1958 | Ernst | 417/398 |
| 3,178,153 | 4/1965 | Jacomet | 169/48 |
| 3,652,186 | 3/1972 | Carter | 417/370 |
| 3,653,785 | 4/1972 | Dahlgren et al. | 417/367 |
| 3,659,674 | 5/1972 | Ferrario | 184/6.16 |
| 3,947,154 | 3/1976 | Klepp et al. | 417/373 |
| 4,545,741 | 10/1985 | Tomioka et al. | 417/365 |
| 4,682,936 | 7/1987 | Suzuki et al. | 417/366 |
| 4,775,293 | 10/1988 | Boster | 415/180 |
| 4,902,204 | 2/1990 | Hofstad | 417/405 |
| 5,015,156 | 5/1991 | Scholz | 417/370 |
| 5,051,071 | 9/1991 | Haentjens | 417/373 |
| 5,498,141 | 3/1996 | Agger | 417/375 |

FOREIGN PATENT DOCUMENTS

| | | | |
|---|---|---|---|
| 554122 | 6/1943 | United Kingdom | 417/398 |

*Primary Examiner*—Willis R. Wolfe
*Attorney, Agent, or Firm*—Kelly Bauersfeld Lowry & Kelley, LLP

[57] ABSTRACT

An improved fuel transfer pump is provided for use in transferring fuel within fuel tanks such as fuel tanks within an aircraft. The pump comprises a relatively compact and substantially modular pump assembly including a rotatably driven impeller carried at one end of an impeller shaft for relatively high flow transfer of fuel from a fuel inlet to a fuel outlet. The impeller shaft is rotatably supported within a pump housing by sets of angular contact bearings preloaded in a direction to prevent eccentric run-out or excessive axial end play in response to bearing wear over the operating life of the pump. In addition, an hydraulic motor is mounted within the pump housing axially between the bearing sets and is driven by a source of hydraulic fluid for rotatably driving the impeller shaft. Inherent leakage of hydraulic fluid from the motor is circulated to and past the bearing sets and related shaft seals for cooling these components, thereby preventing pump overheating and possible ignition of fuel vapors during a dry run condition. A seal assembly is mounted on the impeller shaft for substantially preventing leakage of hydraulic fluid into a fuel flow path and vice versa. The seal assembly includes a pair of carbon seals rotatably mounted on the impeller shaft on opposite sides of an internally ported stationary seal ring.

31 Claims, 2 Drawing Sheets

FUEL TRANSFER PUMP

BACKGROUND OF THE INVENTION

This invention relates generally to improvements in fuel transfer pumps, particularly of the type designed for use in transferring fuel from a fuel tank in an aircraft. More specifically, this invention relates to an improved and simplified fuel transfer pump of the type having an hydraulic motor for rotatably driving a pump impeller, wherein the hydraulic motor and pump are arranged in a compact modular package to include bearing and seal means designed for eliminating risk of potentially catastrophic ignition of fuel vapors during unlimited operation in a depleted tank.

Relatively high flow fuel transfer pumps are generally well known in the aviation industry for use in pumping fuel from a fuel tank. Such fuel pumping applications include, for example, engine feed or in-flight refueling of an aircraft. Moreover, it is sometimes desirable to transfer fuel from one tank to another on an aircraft for purposes of achieving a more uniform distribution of weight during a partial fuel load condition. For this purpose, fuel transfer pumps have been developed and are frequently designed for installation of several such pumps directly into one or more fuel tanks on an aircraft, wherein the pumps are immersed within the fuel under normal conditions.

Concurrently, many such fuel transfer pumps are powered by an electric motor for rotating an impeller immersed in the fuel to pump fuel through an appropriate fuel outlet to another location. Importantly, in fuel transfer pumps of this type, the fuel being pumped has typically been used as a cooling fluid to transfer heat away from mechanical heat-generating pump surfaces such as bearings and the motor, to prevent generation of excessive heat which could otherwise present a potential ignition source in the presence of volatile fuel vapors. Unfortunately, reliance upon the fuel as a cooling fluid results in a pump design susceptible to overheating and possible fuel vapor ignition in the not uncommon event that the pump is operated for any significant period of time with the fuel tank in an empty or nearly empty condition.

In an effort to address and resolve this potentially catastrophic failure mode in fuel-cooled prior art transfer pumps, alternative hydraulic powered transfer pumps have been developed wherein a source of hydraulic fluid under pressure is provided for driving an hydraulic motor coupled to the pump impeller. See, for example, U.S. Pat. No. Re. 35,404. In a fuel transfer pump of this type, hydraulic fluid is available preferably in the form of inherent internal motor leakage for cooling mechanical pump components in a manner reducing or eliminating the potential for overheating during a dry run condition. However, such hydraulically driven pumps have typically been relatively complex in design and require a separate hydraulic motor.

There exists, therefore, a continuing need for further improvements in and to fuel transfer pumps, particularly of the hydraulically driven type, wherein the pump has a simplified compact design configuration and further includes an impeller and related shaft mounting arrangement designed to eliminate heat generation sources which could otherwise contribute to undesirable ignition of fuel vapors. The present invention fulfills these needs and provides further related advantages.

SUMMARY OF THE INVENTION

In accordance with the invention, an improved fuel transfer pump is provided for use in transferring fuel from a fuel tank, particularly for use in an aircraft engine feed or related fuel transfer environment. The improved pump comprises an impeller supported within a shroud defining a fuel inlet and a fuel outlet, wherein the impeller is carried by an impeller shaft rotatably supported by axially preloaded bearing sets within a pump housing. An hydraulic motor is mounted within the pump housing axially between the bearing sets and is supplied with a source of hydraulic pressure for rotatably driving the impeller shaft. Inherent internal leakage of hydraulic fluid from the motor is circulated within the pump housing to and past the bearing sets and related shaft seals for cooling these components during pump operation, and more particularly in a depleted fuel tank if the pump is left running.

In the preferred form of the invention, and in a manner similar to that shown in U.S. Pat. No. Re. 35,404, the bearing sets comprise angular contact bearings. One or more spring members are provided within the pump housing to react between the pump housing and the outer bearing race for preloading the impeller shaft in a direction to prevent eccentric run-out or axial end play arising from bearing wear during the life of the pump. In addition, the impeller shaft is elongated and the bearing sets are spaced axially apart by a sufficient distance to provide a relatively stiff shaft mount with reduced levels of eccentric motion. The axial spacing between the bearing sets is also sufficient to accommodate coaxial mounting of the hydraulic motor, such as an axial piston swash plate type motor for rotatably driving the impeller shaft. Internal leakage of hydraulic fluid from the motor is circulated bidirectionally along the impeller shaft for lubricating and cooling the bearing sets, and also for cooling the mechanical shaft seals mounted on the impeller shaft adjacent the impeller. An internal bore formed in the impeller shaft in combination with a radially open flow port in the shaft provides an auxiliary pump for circulating the hydraulic fluid for cooling purposes. In addition, a unique dual shaft seal arrangement is incorporated at the hydraulic fluid/fuel interface for separation using a single seat element for two rotating seals, which seat element is integrally ported to communicate with a drain line to the outside of the fuel tank.

Other features and advantages of the invention will become apparent from the following more detailed description, taken in conjunction with the accompanying drawings which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENT

Figure 2:
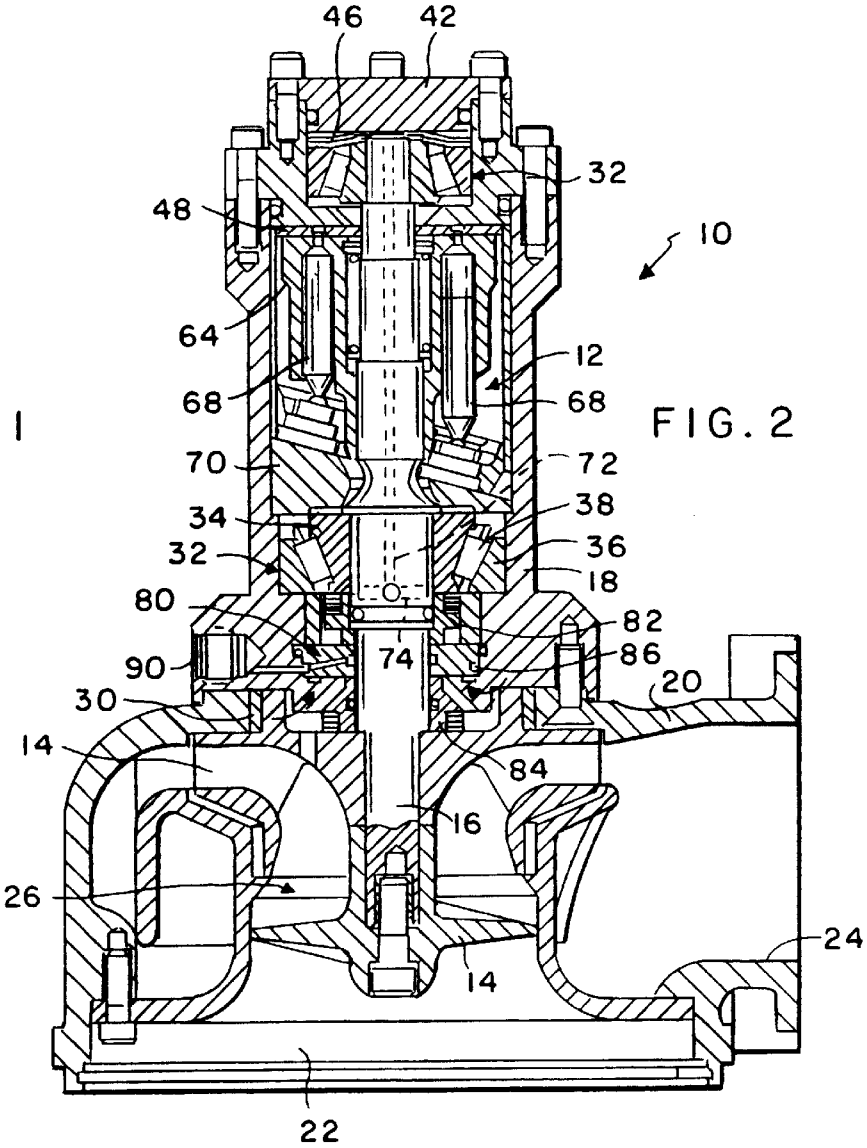
FIG. 2 is a vertical sectional view taken generally along the line 2—2 of FIG. 1.

As shown in the exemplary drawings, an improved fuel transfer pump referred to generally by the reference number 10 is provided for transferring fuel from a fuel tank (not shown), particularly in an aircraft engine feed or other fuel transfer application. The fuel transfer pump 10 comprises, in general, a compact and modular pump assembly or package including a hydraulic motor 12 for rotatably driving an impeller 14 for pumping fuel from a fuel tank to another location. The hydraulic motor 12 is coupled to the impeller 14 by an impeller shaft 16 supported within a pump housing 18 in a manner eliminating risk of overheating particularly in a dry run condition, wherein such overheating could otherwise cause undesirable and potentially catastrophic ignition of volatile fuel vapors.

Figure 1:
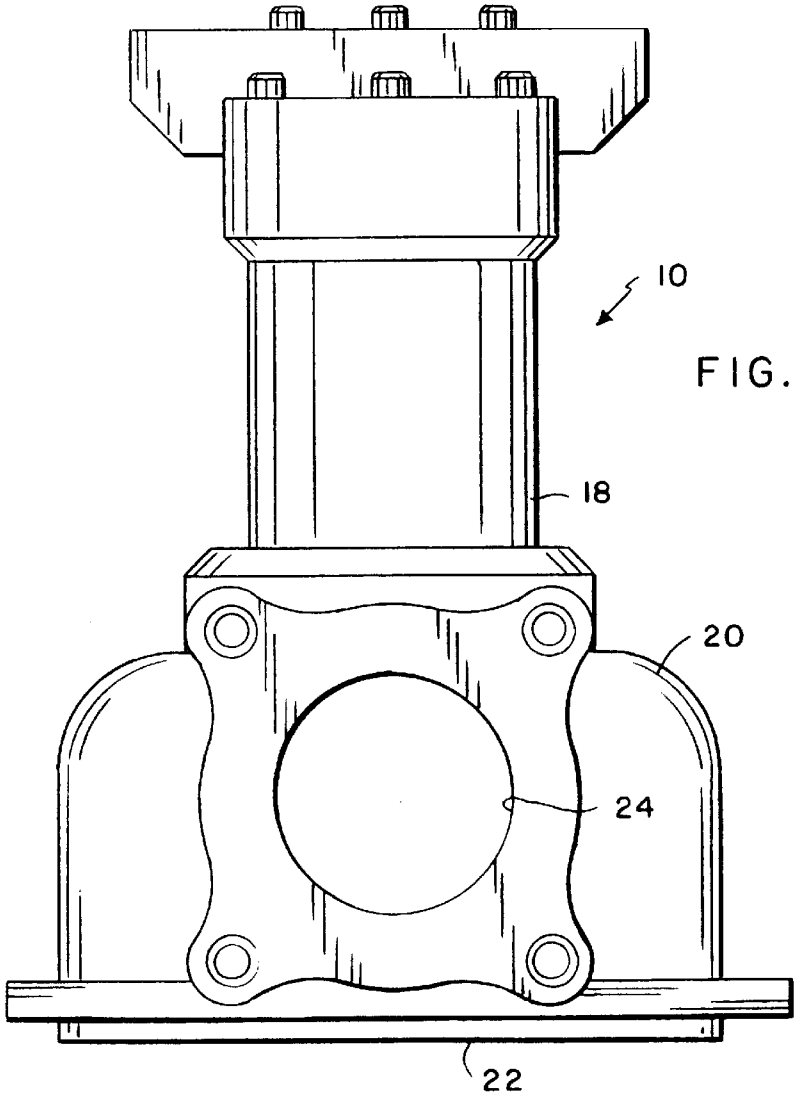
FIG. 1 is a front elevational view illustrating an improved fuel transfer pump embodying the features of the present invention.

The fuel transfer pump 10 of the present invention is designed for mounting directly into a fuel tank in a position immersed within the fuel, typically with a plurality of such pumps beings provided for concurrent operation to achieve rapid transfer of the fuel. As shown in FIGS. 1 and 2, the pump housing 18 incorporates a contoured shroud 20 at a lower end thereof to define a downwardly open fuel inlet 22 and a radially or laterally open fuel outlet 24. The shroud 20 further defines a fuel flow path 26 extending between the fuel inlet 22 and outlet 24, and the impeller 14 is rotatably mounted along this flow path 26 for pumping the fuel from the associated fuel tank via the outlet 24. In this regard, the fuel outlet 24 is normally coupled to an appropriate fuel transfer conduit (not shown) for delivery of the pumped fuel to another site.

The illustrative drawings show the impeller 14 in the form of a mixed axial and centrifugal flow type impeller mounted along the flow path 26 in a position for drawing fuel upwardly through the inlet 22, and for discharging the fuel through a volute chamber to the outlet 24. In this regard, the impeller 14 is normally installed within the shroud 20 in relatively close running clearance therewith to achieving relatively high pumping efficiency. More specifically, the impeller 14 may be mounted within the shroud 20 with diametrical running clearances as small as 0.010 inch, especially between cylindrical impeller wear ring 30 (sometimes called labyrinth seal) and the adjacent housing shroud. In accordance with one aspect of the invention, the impeller shaft 16 rotatably supports the impeller 14 in a manner which effectively minimizes and controls eccentric impeller run-out and excessive axial end play which could otherwise occur as a result of bearing wear over the course of time, and cause heat generation attributable to running contact between the impeller and shroud. Such heat generation could, of course, create a highly undesirable risk of igniting fuel vapors.

Figure 3:
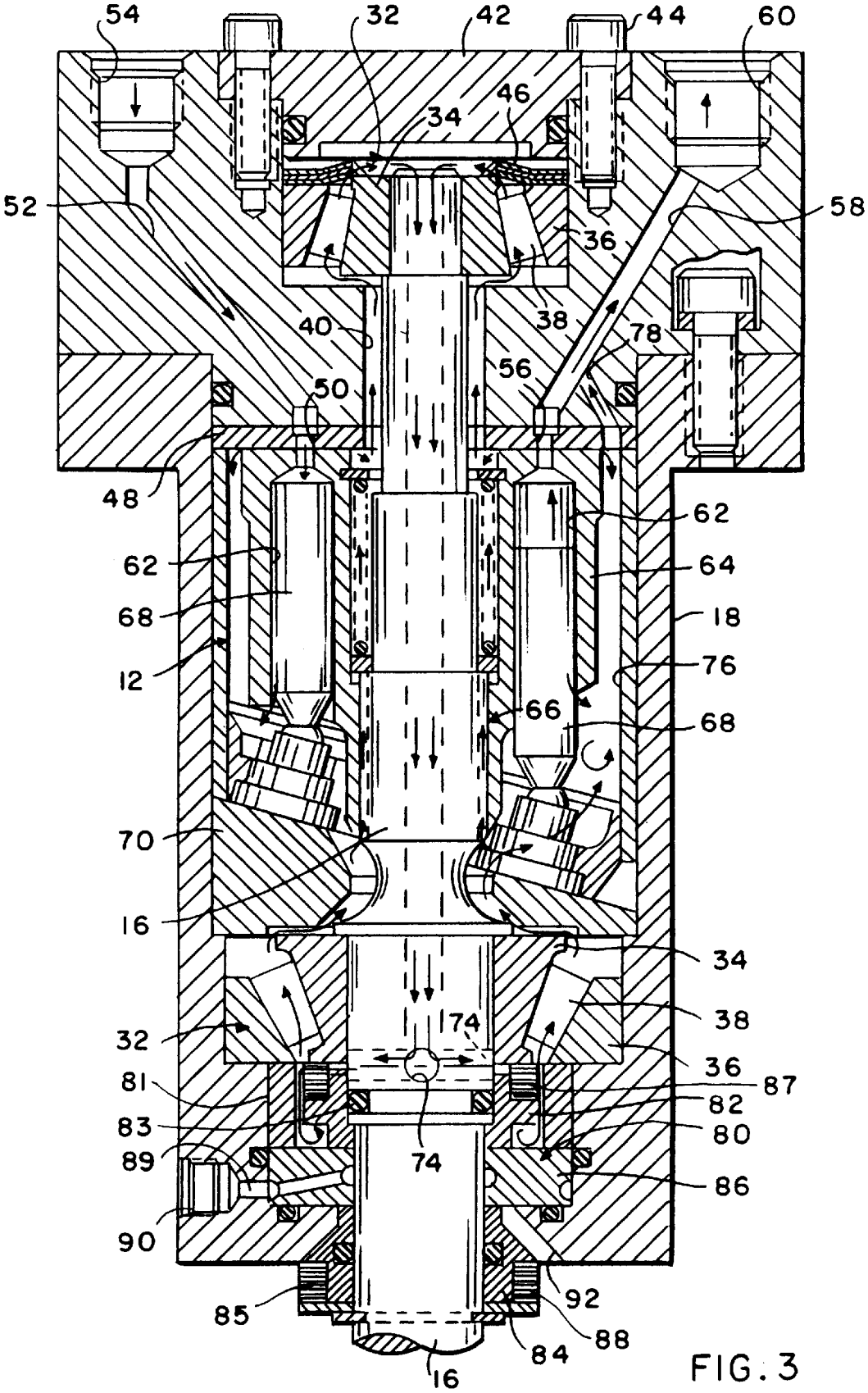
FIG. 3 is an enlarged fragmented vertical sectional view similar to FIG.2, and showing further construction details of the invention.

As shown best in FIG. 3, the impeller shaft 16 comprises an elongated shaft mounted within the pump housing 18 and supported for rotation therein by a pair of axially preloaded bearing sets 32. In the preferred form, these bearing sets 32 each comprise an angular contact bearing such as a tapered roller bearing having an inner race 34, an outer race 36, and a plurality of rolling bearing elements such as rollers 38 captured and angularly disposed therebetween. The bearing sets 32 rotatably support the impeller shaft 16 within an elongated bore 40 formed in the pump housing 18, with a first bearing set disposed at an outboard end of the shaft 16 adjacent the impeller 14 and a second bearing set generally at an inboard end of the shaft opposite the impeller. As shown, a lower end of the bore 40 is open to permit passage of the shaft 16 downwardly into the interior of the shroud 20 where the impeller 14 is carried thereon. An upper end of the bore 40 is closed by a cap 42 or the like fastened to the housing 18 as by bolts 44. Spring means such as a plurality of wave springs 46 are interposed between the outer race 36 of the upper bearing set 32 to apply an axial force preloading the impeller shaft 16 and the impeller 14 thereon in a downward direction toward the impeller. A further discussion of the use of angular contact bearings for axially preloading an impeller shaft in a hydraulically driven fuel transfer pump may be found in U.S. Pat. No. Re. 35,404, which is incorporated by reference herein.

In accordance with a further aspect of the invention, the hydraulic motor 12 is mounted directly within the pump housing 18 at a position axially between the bearing sets 32, and coaxially about the impeller shaft 16. The illustrative hydraulic motor 12 comprises a compact axial piston pump-motor of the swash plate type, including a pump head or face 48 of generally annular shape and defining an intake port 50 adapted for connection with a pressure port 52 coupled via a suitable fitting 54 to a source of hydraulic fluid under pressure. The pump head 48 further defines a discharge port 56 adapted for connection with a return port 58 coupled via a suitable fitting 60 for recycling hydraulic fluid to the pressure source. The intake and discharge ports 50, 56 communicate with a plurality of axially elongated cylinders 62 formed in a rotary barrel 64 which is keyed or splined as indicated at 66 for rotation with the impeller shaft 16. Individual pistons 68 carried within the cylinders 62 retract upon introduction of hydraulic fluid under pressure to act against an eccentric swash plate 70 in a manner causing pistons aligned with the discharge port 56 to advance, and further causing the barrel 64 to rotate. Rotation of the barrel 64 of the hydraulic motor 12 results, as previously described, in rotation of the impeller shaft 16 for purposes of rotatably driving the impeller 14 to pump fuel.

The hydraulic motor 12 incurs a minor degree of inherent internal leakage of hydraulic fluid, and this hydraulic fluid is utilized to lubricate and cool the bearing sets 32 during operation of the fuel transfer pump 10. More particularly, a significant proportion of this fluid leakage typically occurs at the open opposite ends of the cylinders 62 formed in the rotary barrel 64. As indicated by the arrows in FIG. 3, such fluid leakage tends to flow axially along the impeller shaft 16 to and through the upper bearing set 32 for lubrication and cooling purposes. From here, the fluid can pass axially through a small bore 72 formed internally within the impeller shaft 16 for flow to a plurality of radially outwardly open flow ports 74 formed in the shaft 16 near the lower end of the pump housing 18 at an outboard side of the lower bearing set 32. The shaft bore 72 and flow ports 74 essentially form an auxiliary pump for promoting such hydraulic fluid flow. The fluid passes to and through the lower bearing set 32 and recirculates back to a cavity 76 at a low pressure side of the barrel 64 for collection and flow through a bypass port 78 to the return port 58.

The above described circulation of hydraulic fluid through the pump housing 18 also functions to cool a redundant seal assembly 80 mounted within the housing bore 40 at an axially outboard side of the lower bearing set 32, to prevent significant leakage of hydraulic fluid from the pump housing 18 into the fuel impeller cavity, or vice versa. This seal assembly 80 comprises, in the preferred form, a pair of carbon shaft seals 82 and 84 sealed by O-rings 83 and 85 and fitted onto the shaft 16 in axially spaced relation on opposite sides of a hardened steel seal ring 86. The seal ring 86 is axially spaced from the outer race 36 of the first bearing set 32 by means of a spacer 81. The carbon shaft seals 82 and 84 rotate with the shaft 16 and are spring loaded against the seal ring 86 by means of flat wire compression springs 87 and 88 to compensate for wear on the carbon faces during the life of the pump 10. The upper shaft seal 82 is positioned at the axially outboard side of the radial flow ports 74 in the shaft 16 and thus is contacted by the hydraulic fluid pumped from these ports 74. A portion of this hydraulic fluid is allowed to flow around the outside diameter of the shaft seal 82 to contact and cool the seal ring 86. The cavity between the carbon seal faces within which the seal ring 86 is positioned is vented by means of piping to atmosphere outside the fuel tank via a port 89 and fitting 90, wherein this vent path can be monitored upon initial pump set-up for excess fluid leakage past the seal ring 86 and if desired thereafter plugged if leakage does not exceed specifications. The lower shaft seal 84 prevents fuel under pressure from entering the cavity.

The use of a single seal ring 86 or seat for the two carbon rotating seals 82 and 84 allows direct cooling of the ring by hydraulic oil during operation with an empty fuel tank and allows a more compact configuration than that used in U.S. Pat. No. Re. 35,404.

In operation, the fuel transfer pump 10 functions to rapidly pump fuel from the inlet 22 to the outlet 24 in response to coupling the hydraulic motor 12 to the source of hydraulic fluid under pressure. Internal motor leakage is effectively circulated to and through the bearing sets 32 for cooling and lubrication, and also to the seal assembly 80 for cooling. The geometry of the impeller shaft 16 provides an auxiliary pump for promoting the desired fluid circulation, wherein this circulation is enhanced particularly by the lower bearing set 32 with the angularly oriented bearing elements 38. Positioning the hydraulic motor 12 axially between the bearing sets 32 is made possible by use of the elongated impeller shaft 16 which is thus relatively stiffer in operation and therefore less susceptible to eccentric motion. Moreover, this arrangement effectively prolongs bearing and seal life as a result of reduced eccentric forces. In the event of bearing wear over an extended period of time, the spring means 46 axially preloads the shaft to prevent eccentric runout and/or excess axial end play.

A variety of modifications and improvements in and to the improved fuel transfer pump of the present invention will be apparent to those persons skilled in the art. Accordingly, no limitation on the invention is intended by way of the foregoing description and accompanying drawings, except as set forth in the appended claims.

What is claimed is:

1. A fuel transfer pump for transferring liquid fuel from a fuel tank, said pump comprising:

a pump housing including shroud means defining a fuel inlet, a fuel outlet, and a fuel flow path extending between said inlet and said outlet;

an impeller disposed along said fuel flow path for pumping fuel from said inlet to said outlet;

an impeller shaft carrying said impeller;

bearing means within said pump housing for rotatably supporting said impeller shaft, said bearing means including a pair of axially spaced bearing sets, each comprising tapered roller bearings; and an hydraulic motor mounted within said pump housing at a location axially between said bearing sets, said hydraulic motor being coupled to said impeller shaft for rotatably driving said impeller shaft upon connection of said hydraulic motor to a source of hydraulic fluid under pressure.

2. A fuel transfer pump for transferring liquid fuel from a fuel tank, said pump comprising;

a pump housing including shroud means defining a fuel inlet, a fuel outlet, and a fuel flow path extending between said inlet and said outlet;

an impeller disposed along said fuel flow path for pumping fuel from said inlet to said outlet;

an impeller shaft carrying said impeller;

bearing means within said pump housing for rotatably supporting said impeller shaft, said bearing means including a pair of axially spaced bearing sets;

an hydraulic motor mounted within said pump housing at a location axially between said bearing sets, said hydraulic motor being coupled to said impeller shaft for rotatably driving said impeller shaft upon connection of said hydraulic motor to a source of hydraulic fluid under pressure; and means for circulating internal hydraulic fluid leakage from said motor to and through said bearing sets for lubricating and cooling said bearing sets, wherein said circulating means includes an auxiliary pump formed by an axially elongated bore in said impeller shaft leading to at least one radially open flow port.

3. A fuel transfer pump for transferring liquid fuel from a fuel tank, said pump comprising;

a pump housing including shroud means defining a fuel inlet, a fuel outlet, and a fuel flow path extending between said inlet and said outlet;

an impeller disposed along said fuel flow path for pumping fuel from said inlet to said outlet;

an impeller shaft carrying said impeller;

bearing means within said pump housing for rotatably supporting said impeller shaft, said bearing means including a pair of axially spaced bearing sets;

an hydraulic motor mounted within said pump housing at a location axially between said bearing sets, said hydraulic motor being coupled to said impeller shaft for rotatably driving said impeller shaft upon connection of said hydraulic motor to a source of hydraulic fluid under pressure;

means for circulating internal hydraulic fluid leakage from said motor to and through said bearing sets for lubricating and cooling said bearing sets; and a seal assembly mounted on said impeller shaft within said pump housing for substantially preventing leakage of hydraulic fluid into said fuel flow path, said circulating means additionally circulating internal hydraulic fluid leakage from said motor to cool said seal assembly, wherein the seal assembly includes a pair of carbon seals rotatably mounted on the impeller shaft on opposite sides of a stationary seal ring.

4. The fuel transfer pump of claim 3 wherein the stationary seal rings is internally ported to communicate with an externally vented drain line.

5. The fuel transfer pump of claim 3 wherein the carbon seals are biased toward the seal ring by compression springs.

6. A fuel transfer pump for transferring liquid fuel from a fuel tank, said pump comprising;

a pump housing including shroud means defining a fuel inlet, a fuel outlet, and a fuel flow path extending between said inlet and said outlet;

an impeller shaft carrying said impeller;

bearing means within said pump housing for rotatably supporting said impeller shaft, said bearing means including a pair of axially spaced bearing sets;

an hydraulic motor mounted within said pump housing at a location axially between said bearing sets, said hydraulic motor being coupled to said impeller shaft for rotatably driving said impeller shaft upon connection of said hydraulic motor to a source of hydraulic fluid under pressure; and at least one spring which provides means for axially preloading said bearing sets.

7. The fuel transfer pump of claim 1 wherein said hydraulic motor comprises an axial piston motor mounted within said pump housing coaxial to said impeller shaft.

8. The fuel transfer pump of claim 1 wherein said bearing sets comprise a pair of angular contact bearings.

9. The fuel transfer pump of claim 8 wherein said angular contact bearings comprise tapered roller bearings.

10. The fuel transfer pump of claim 1 wherein said bearing sets comprise a first bearing set disposed generally at an outboard end of said impeller shaft adjacent said impeller, and a second bearing set disposed generally at an inboard end of said impeller shaft opposite said impeller, and wherein said at least one spring axially preloading said impeller shaft in a direction toward said outboard end.

11. The fuel transfer pump of claim 10 wherein said first and second bearing sets comprise a pair of angular contact bearings.

12. The fuel transfer pump of claim 1 wherein said at least one spring reacts between said pump housing and said second bearing set.

13. The fuel transfer pump of claim 12 wherein said at least one spring comprises at least one wave spring.

14. The fuel transfer pump of claim 1 further including means for circulating internal hydraulic fluid leakage from said motor to and through said bearing sets for lubricating and cooling said bearing sets.

15. The fuel transfer pump of claim 14 wherein said circulating means includes an auxiliary pump formed by an axially elongated bore in said impeller shaft leading to at least one radially open flow port.

16. The fuel transfer pump of claim 14 further including a seal assembly mounted on said impeller shaft within said pump housing for substantially preventing leakage of hydraulic fluid into said fuel flow path, said circulating means additionally circulating internal hydraulic fluid leakage from said motor to cool said seal assembly.

17. The fuel transfer pump of claim 16 wherein the seal assembly includes a pair of carbon seals rotatably mounted on the impeller shaft on opposite sides of a stationary seal ring.

18. The fuel transfer pump of claim 17 wherein the stationary seal ring is internally ported to communicate with an externally vented drain line.

19. The fuel transfer pump of claim 17 wherein the carbon seals are biased toward the seal ring by compression springs.

20. A fuel transfer pump for transferring liquid fuel from a fuel tank, said pump comprising:

a pump housing including shroud means defining a fuel inlet, a fuel outlet, and a fuel flow path extending between said inlet and said outlet;

an impeller disposed along said fuel flow path for pumping fuel from said inlet to said outlet;

an impeller shaft carrying said impeller;

bearing means within said pump housing for rotatably supporting said impeller shaft, said bearing means including a first bearing set disposed generally at an outboard end of said impeller shaft adjacent to said impeller and a second bearing set disposed generally at an inboard end of said impeller shaft opposite to said impeller;

spring means for axially preloading said impeller shaft in a direction toward said impeller;

an hydraulic motor mounted within said pump housing at a location coaxial to said impeller shaft and axially between said first and second bearing sets, said hydraulic motor being coupled to said impeller shaft for rotatably driving said impeller shaft upon connection of said hydraulic motor to a source of hydraulic fluid under pressure; and circulating means for circulating internal hydraulic fluid leakage from said hydraulic motor to said bearing sets for lubricating and cooling said bearing sets.

21. The fuel transfer pump of claim 20 wherein said spring means comprises at least one wave spring reacting between said pump housing and said second bearing set.

22. The fuel transfer pump of claim 20 wherein said bearing sets comprise a pair of angular contact bearings.

23. The fuel transfer pump of claim 20 wherein said circulating means includes an auxiliary pump formed by an axially elongated bore in said impeller shaft leading to at least one radially open flow port.

24. The fuel transfer pump of claim 20 wherein said hydraulic motor comprises an axial piston motor.

25. The fuel transfer pump of claim 20 further including a seal assembly comprising a pair of carbon seals mounted on said impeller shaft within said pump housing on opposite sides of a stationary seal ring, for substantially preventing leakage of hydraulic fluid into said fuel flow path and vice versa, the carbon seals being biased toward the seal ring by compression springs, and said circulating means additionally circulating internal hydraulic fluid leakage from said motor to cool said seal ring assembly.

26. The fuel transfer pump of claim 25, wherein the stationary seal ring is internally ported to communicate with an externally vented drain line.

27. A fuel transfer pump for transferring liquid fuel from a fuel tank, said pump comprising:

a pump housing defining a fuel inlet, a fuel outlet, and a fuel flow path extending between said inlet and said outlet;

an impeller disposed along said fuel flow path for pumping fuel from said inlet to said outlet;

an impeller shaft carrying said impeller;

a pair of axially spaced bearing sets within said pump housing for rotatably supporting said impeller shaft;

an hydraulic motor mounted within said pump housing at a location axially between said bearing sets, said hydraulic motor being coupled to said impeller shaft for rotatably driving said impeller shaft upon connection of said hydraulic motor to a source of hydraulic fluid under pressure; and a seal assembly including a pair of carbon seals rotatably mounted on the impeller shaft on opposite sides of a stationary seal ring, for substantially preventing leakage of hydraulic fluid into said fuel flow path and vice versa.

28. The fuel transfer pump of claim 27, wherein the carbon seals are biased toward the seal ring by compression springs, and wherein the stationary seal ring is internally ported to communicate with an externally vented drain line.

29. The fuel transfer pump of claim 27 wherein said bearing sets comprise a first bearing set disposed generally at an outboard end of said impeller shaft adjacent said impeller, and a second bearing set disposed generally at an inboard end of said impeller shaft opposite said impeller, and further including means for axially preloading said impeller shaft in a direction toward said outboard end.

30. The fuel transfer pump of claim 29 wherein said axially preloading means comprises at least one spring reacting between said pump housing and said second bearing set, and wherein said at least one spring comprises at least one wave spring.

31. The fuel transfer pump of claim 30 further including means for circulating internal hydraulic fluid leakage from said motor to and through said bearing sets for lubricating and cooling said bearing sets.

* * * * *